US011717100B2

(12) United States Patent
Hu

(10) Patent No.: US 11,717,100 B2
(45) Date of Patent: Aug. 8, 2023

(54) WATER-BLOCKING AND AIR-ENTERABLE STRUCTURE OF DUAL DRINKING-MODE CUP

(71) Applicant: ZHEJIANG FLY CUP CO., LTD., Yongkang (CN)

(72) Inventor: Feipeng Hu, Yongkang (CN)

(73) Assignee: ZHEJIANG FLY CUP CO., LTD., Yongkang (CN)

( * ) Notice: Subject to any disclaimer, the term of this patent is extended or adjusted under 35 U.S.C. 154(b) by 163 days.

(21) Appl. No.: 17/315,404

(22) Filed: May 10, 2021

(65) Prior Publication Data

US 2022/0354282 A1 Nov. 10, 2022

(51) Int. Cl.
*A47G 19/22* (2006.01)
*B65D 43/02* (2006.01)

(52) U.S. Cl.
CPC ..... *A47G 19/2272* (2013.01); *B65D 43/0212* (2013.01); *B65D 2543/00046* (2013.01); *B65D 2543/00092* (2013.01); *B65D 2543/00537* (2013.01); *B65D 2543/00972* (2013.01)

(58) Field of Classification Search
CPC ..... A47G 19/2266; A47G 19/2272; B65D 43/0212; B65D 2543/00972; B65D 2543/00537; B65D 2543/00092; B65D 2543/00046
USPC ..... 220/713
See application file for complete search history.

(56) References Cited

U.S. PATENT DOCUMENTS 10,159,368 B2 * 12/2018 Lin ..... B65D 43/16
2003/0168455 A1 * 9/2003 Zettle ..... B65D 47/0895 220/714

* cited by examiner

*Primary Examiner* — James N Smalley
*Assistant Examiner* — Madison L Poos
(74) *Attorney, Agent, or Firm* — WPAT, P.C

(57) ABSTRACT

A water-blocking and air-enterable structure includes a cup lid disposed with a direct drinking mouth assembly and a drinking nozzle assembly. The direct drinking mouth assembly includes a direct drinking mouth flap, a direct drinking mouth plug and an air inlet plug. The cup lid is provided with a spout and a first air inlet. The drinking nozzle assembly includes a drinking nozzle flap, a drinking nozzle seat, a drinking nozzle and an air inlet valve. The cup lid is provided with a second air inlet plugged by the air inlet valve, and a lower end of the drinking nozzle is connected with the air inlet valve through a plastic strip. The structure adopts two drinking-modes of using the direct drinking mouth assembly and the drinking nozzle assembly both being integral structures, the problems of loss of components, difficult assembly, and assembly dislocation can be avoided.

10 Claims, 7 Drawing Sheets

WATER-BLOCKING AND AIR-ENTERABLE STRUCTURE OF DUAL DRINKING-MODE CUP

FIELD OF THE DISCLOSURE

The disclosure relates to the field of cups, and more particularly to a water-blocking and air-enterable structure of a dual drinking-mode cup.

BACKGROUND OF THE DISCLOSURE

Cups are necessary tools for most people to drink water. Most of the cups have only one drinking-mode. A cup lid of a coffee cup usually is equipped with a spout and an air inlet, the air inlet is assembled with a small plug, and a plug for the spout also adopts the assembly manner. Because the plugs themselves are relatively small in sizes, which would cause problems such as assemblies of them are troublesome or not in place, difficult to assemble after disassembly, easy to lose, and water leakage. Some of cup lids each are provided with one air inlet on the side, if a plug for the air inlet is too large, it is easy to cause a risk of tilting or shaking of the cup lid, whereas if the plug for the air inlet is too small, it is easy to cause problems such as water leakage.

In another aspect, a cup lid may be provided with a drinking nozzle, the drinking nozzle usually is communicated with a suction pipe through a flexible pipe. The cup lid is further provided with an air inlet, a movable flap is arranged above the drinking nozzle, the movable flap is hinged to a drinking nozzle seat, and the movable flap is provided with a soft plug. Because the movable flap has a gap for moving, when the movable flap is closed, the soft plug and the air inlet are easily to be dislocated from each other, resulting in an unsatisfactory sealing and thereby causing a water leakage. If the plug for the air inlet is individually configured, it is not only easy to lose, but also easy to fall into the cup and then be swallowed by mistake if the assembly is not in place.

SUMMARY OF THE DISCLOSURE

In order to solve the above problems in the related arts, the disclosure provides a water-blocking and air-enterable structure of a dual drinking-mode cup. The technical problems to be solved by the disclosure may be realized by following technical solutions.

Specifically, a water-blocking and air-enterable structure of a dual drinking-mode cup is provided and may include: a cup lid arranged on an upper end of a cup body, and the cup lid being disposed with a direct drinking mouth assembly and a drinking nozzle assembly.

The direct drinking mouth assembly may include a direct drinking mouth flap, a direct drinking mouth plug, and an air inlet plug. An end of the direct drinking-mouth flap is rotatably connected to the cup lid. The cup lid is provided with a spout and a first air inlet. The direct drinking mouth plug and the air inlet plug both are arranged on the direct drinking mouth flap. The direct drinking mouth plug is configured (i.e., structured and arranged) for being plugged into the spout along with a rotation of the direct drinking mouth flap to seal, and the air inlet plug is configured for being plugged into the first air inlet along with a rotation of the direct drinking mouth flap to seal.

The drinking nozzle assembly may include a drinking nozzle flap, a drinking nozzle seat, a drinking nozzle, and an air inlet valve. An end of the drinking nozzle flap is rotatably connected to the cup lid. A lower end of the drinking nozzle is fixed into the cup lid, and the drinking nozzle is communicated with the cup body. A side of the cup lid near the drinking nozzle is formed with a second air inlet. The air inlet valve is plugged into the second air inlet, the lower end of the drinking nozzle is connected to the air inlet valve by a plastic strip. An end of the drinking nozzle seat is hinged to the drinking mouth flap, and another end of the drinking nozzle seat is sleeved onto the drinking nozzle.

In a preferred embodiment, a top of the cup lid is provided with two parallel elongated grooves transversally extended, and a bottom wall of each of the elongated grooves is formed with the first air inlet downwardly extended. The direct drinking mouth flap exemplarily is U-shaped, and each of two side bars of the direct drinking mouth flap is provided with the air inlet plug. Two the air inlet plugs on the two side bars are configured for being respectively plugged into two the first air inlets formed on the bottom walls of the elongated grooves, along with a rotation of the direct drinking-mouth flap, to seal.

In a preferred embodiment, the top of the cup lid is provided with an accommodating groove, the accommodating groove is located between the two elongated grooves, and an upper end of the drinking nozzle bends into the accommodating groove along with a rotation of the drinking nozzle flap. An upper end of the second air inlet penetrates through an inner bottom wall of the accommodating groove.

In a preferred embodiment, the bottom of the cup lid is provided with a limiting slot. The lower end of the drinking nozzle is provided with a connector. The connector is a hollow cylindrical structure. An outer wall at an upper end of the connector extends outwards to form a small ring-shaped protrusion, the outer wall of a middle part of the connector extends outwards to form a large ring-shaped protrusion, and a ring-shaped groove is defined between the small ring-shaped protrusion and the large ring-shaped protrusion. The connector is interference fitted into the limiting slot.

In a preferred embodiment, the cup lid is provided with a water-blocking silicone ring.

In a preferred embodiment, the drinking nozzle is provided with a snapping rib, the drinking nozzle seat is provided with a fitting groove, and the snapping rib is snapped into the fitting groove.

Compared with the related arts, the above embodiments of the disclosure may have the following beneficial effects.

In one aspect, the cup lid of the disclosure adopts two drinking-modes of using the direct drinking mouth assembly and the drinking nozzle assembly respectively. For the direct drinking mouth assembly, the direct drinking mouth plug, the air inlet plug, and the direct drinking mouth flap are designed as an integral structure, when the direct drinking mouth flap is closed, the direct drinking mouth plug can seal the spout, and the air inlet plug can seal the first air inlet correspondingly, so that the problems such as loss of the direct drinking mouth plug and the air inlet plug, and difficult assembly of the direct drinking mouth plug and the air inlet plug occurred in the related art can be avoided.

In another aspect, the drinking nozzle and the air inlet valve are designed as an integral structure, the assembly is simple, a loss of the air inlet valve can be prevented, and an assembly dislocation of the air inlet valve can be avoided.

BRIEF DESCRIPTION OF THE DRAWINGS

The drawings forming a part of the disclosure are used for further understanding of the disclosure. Illustrative embodiments of the disclosure and descriptions thereof are used to explain the disclosure and do not constitute an improper limitation of the disclosure. In the drawings.

DESCRIPTION OF REFERENCE NUMERALS

Figure 1:
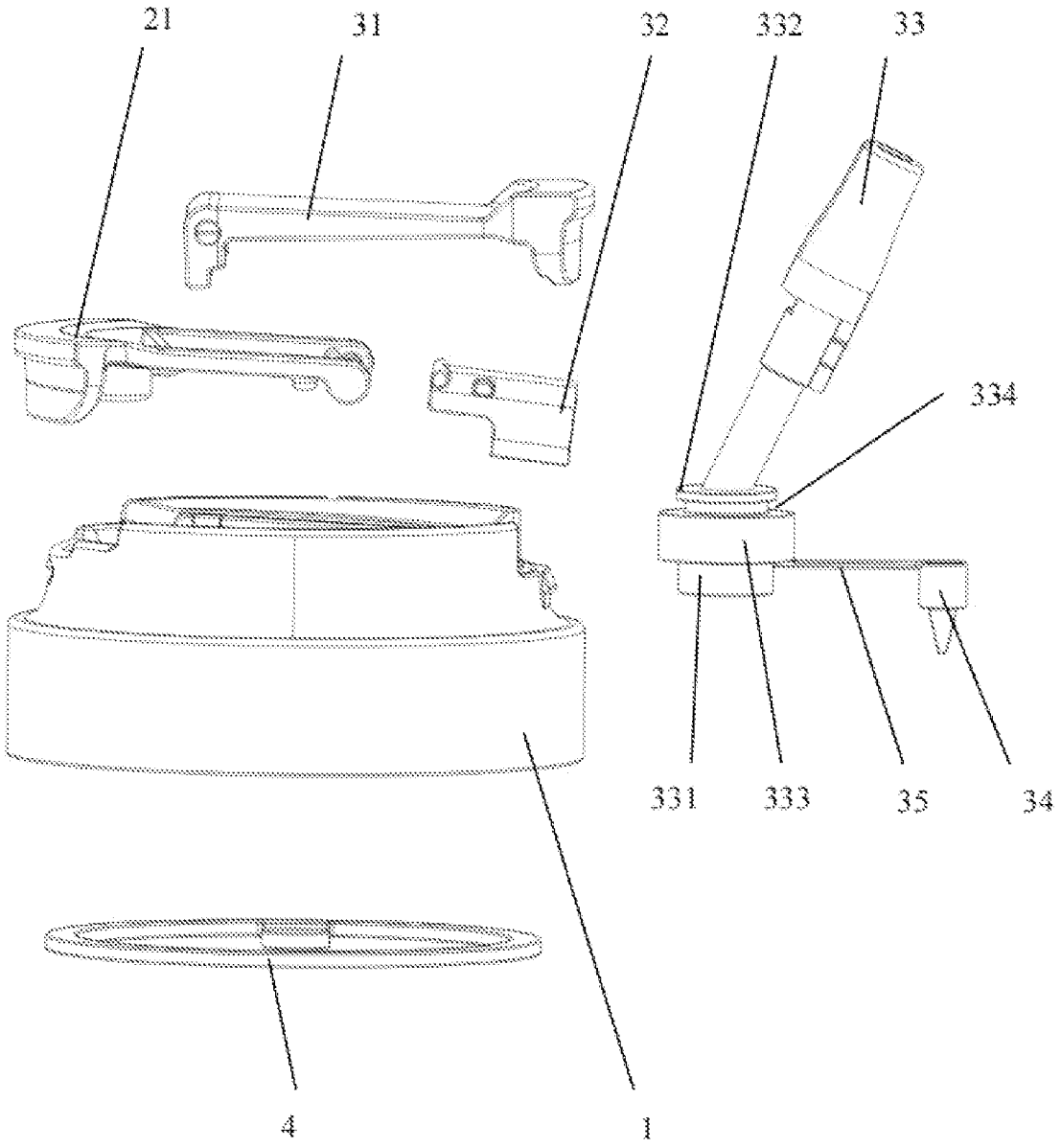
FIG. 1 is a schematic exploded view of a water-blocking and air-enterable structure of a dual drinking-mode cup of the disclosure.

1: Cup lid; 11: Spout; 12: First air inlet; 13: Elongated groove; 14: Accommodating groove; 21: Direct drinking mouth flap; 211: Side bar; 22: Direct drinking mouth plug; 23: Air inlet plug; 31: Drinking nozzle flap; 32: Drinking nozzle seat; 321: Fitting groove; 33: Drinking nozzle; 331: Connector; 322: Snapping rib; 332: Small ring-shaped protrusion; 333: Large ring-shaped protrusion; 334: Ring-shaped groove; 34: Air inlet valve; 35: Plastic strip; 4: Water-blocking silicone ring.

DETAILED DESCRIPTION OF EMBODIMENTS

The disclosure provides a water-blocking and air-enterable structure of a dual drinking-mode cup. In order to make objectives, technical schemes and technical effects of the disclosure more clear and more comprehensive, the disclosure is further described in detail with reference to the attached drawings and embodiments. It should be understood that the specific embodiments described herein are only used to explain the disclosure rather than to limit the disclosure.

It should be noted that terms "first", "second" and the like in the specification and claims of the disclosure and the above drawings are used to distinguish similar objects, and are not necessarily used to describe a specific order or sequence. It should be understood that the data used in this way can be exchanged under appropriate circumstances. In addition, the terms "including" and "having" and any variation of them are intended to cover nonexclusive inclusion. For example, a system, a product or a device containing a series of units is not necessarily limited to those clearly listed, but may include other units that are not clearly listed or are inherent to the system, the product or the device.

Referring to FIG. 1 through FIG. 4, an embodiment of the disclosure provides a water-blocking and air-enterable structure of a dual drinking-mode cup. The water-blocking and air-enterable structure includes a cup lid 1, the cup lid 1 is arranged on an upper end of a cup body 5 as shown in FIG. 1*a*, and the cup lid 1 is disposed with a direct drinking mouth assembly and a drinking nozzle assembly.

The direct drinking mouth assembly includes a direct drinking mouth flap 21, a direct drinking mouth plug 22, and an air inlet plug 23. One end of the direct drinking mouth flap 21 is rotatably connected (also referred to as pivotally connected) to the cup lid 1 through a shaft, so that the direct drinking mouth flap 21 can be opened and closed on the cup lid 1. The cup lid 1 may be provided with a spout 11 (also referred to as direct drinking mouth) and first air inlets 12. The spout 11 is located at an edge of the cup lid 1, and a user can drink water in the cup body 5 from the spout 11. The first air inlet 12 is communicated with the cup body 5. The direct drinking mouth plug 22 and the air inlet plug 23 both are formed on the direct drinking mouth flap 21. The direct drinking mouth plug 22 is configured to be plugged into the spout 11 along with a rotation of the direct drinking mouth flap 21 to seal. The air inlet plug 23 is configured to be plugged into the first air inlet 12, along with a rotation of the direct drinking mouth flap 21, to seal. When the direct drinking mouth flap 21 is opened, the direct drinking mouth plug 22 and the air inlet plug 23 are respectively pulled out from the spout 11 and the first air inlet 12, so that the user can drink the water/liquid in the cup. In the illustrated embodiment, the direct drinking mouth plug 22 and the air inlet plug 23 are connected onto the direct drinking mouth flap 21 in a way of encapsulating to form an integral structure, so that the loss of component can be prevented, and the risk of assembly dislocation can be avoided.

The drinking nozzle assembly includes a drinking nozzle flap 31, a drinking nozzle seat 32, a drinking nozzle 33, and an air inlet valve 34. One end of the drinking nozzle flap 31 is rotatably connected (also referred to as pivotally connected) to the cup lid 1 through a shaft, a lower end of the drinking nozzle 33 is fixed into the cup lid 1, the drinking nozzle 33 is communicated with the internal space of the cup body 5, so that the user can drink water in the cup body 5 from the drinking nozzle 33. One side of the cup lid 1 near the drinking nozzle 33 is formed with a second air inlet 36, and the air inlet valve 34 is plugged into the second air inlet 36 (in other words, the air inlet valve 34 is arranged penetrating through the cup lid 1). The lower end of the drinking nozzle 33 is connected to the air inlet valve 34 by a strip e.g., a plastic strip 35, so that a loss of the air inlet valve 34 can be avoided, the assembly is simple, and a water leakage in the second air inlet 36 would not be occurred. One end of the drinking nozzle seat 32 is hinged to the drinking nozzle flap 31, the other end of the drinking nozzle seat 32 is sleeved onto the drinking nozzle 33, and the drinking nozzle flap 31 drives the drinking nozzle 33 to move by the drinking nozzle seat 32.

In a preferred embodiment, a top of the cup lid 1 is provided with two parallel elongated grooves 13 transversally extended, and a bottom wall of each of the elongated grooves 13 is formed with the first air inlet 12 downwardly extended. The direct drinking mouth flap 21 is U-shaped (e.g., like a shape of doorframe), and each of two side bars 211 of the direct drinking mouth flap 21 is provided with the air inlet plug 23. Two the air inlet plugs 23 on the two side bars 211 are configured to be respectively plugged into two the first air inlets 12 formed on the bottom walls of the elongated grooves 13, along with a rotation of the direct drinking mouth flap 21, to seal.

In a preferred embodiment, the top of the cup lid 1 is provided with an accommodating groove 14, the accommodating groove 14 is located between the two elongated grooves 13, an upper end of the drinking nozzle 33 bends into the accommodating groove 14 along with a rotation of the drinking nozzle flap 31, and an upper end of the second air inlet 36 penetrates through an inner bottom wall of the accommodating groove 14 (correspondingly, the air inlet valve 34 plugged into the second air inlet 36 penetrates through the inner bottom wall of the accommodating groove 14).

In a preferred embodiment, a bottom of the cup lid 1 is provided with a limiting slot 37 as shown in FIG. 1*a* (the drinking nozzle 33 is not shown in FIG. 1*a*), and an upper end of the limiting slot 37 is communicated with the accommodating groove 14. The lower end of the drinking nozzle 33 is provided with a connector 331. The connector 331 is a hollow cylindrical structure, an outer wall of the upper end of the connector 331 extends outwards to form a small ring-shaped protrusion 332, an outer wall of a middle part of the connector 331 extends outwards to form a large ring-shaped protrusion 333, and a ring-shaped groove 334 is defined between the small ring-shaped protrusion 332 and the large ring-shaped protrusion 333. The connector 331 is interference fitted into the limiting slot 37, and in other words, the connector 331 is arranged penetrating through and held by the cup lid 1. The drinking nozzle 33 may be assembled from the bottom of the cup lid 1, the upper end of the drinking nozzle 33 passes through the limiting slot 37 first, and then the small ring-shaped protrusion 332 moves from the bottom of the limiting slot 37 to the upper end of the limiting slot 37. Because an outer diameter of the large ring-shaped protrusion 333 is slightly larger than the limiting slot 37, the large ring-shaped protrusion 333 is interference fitted into the limiting slot 37.

Figure 1A:
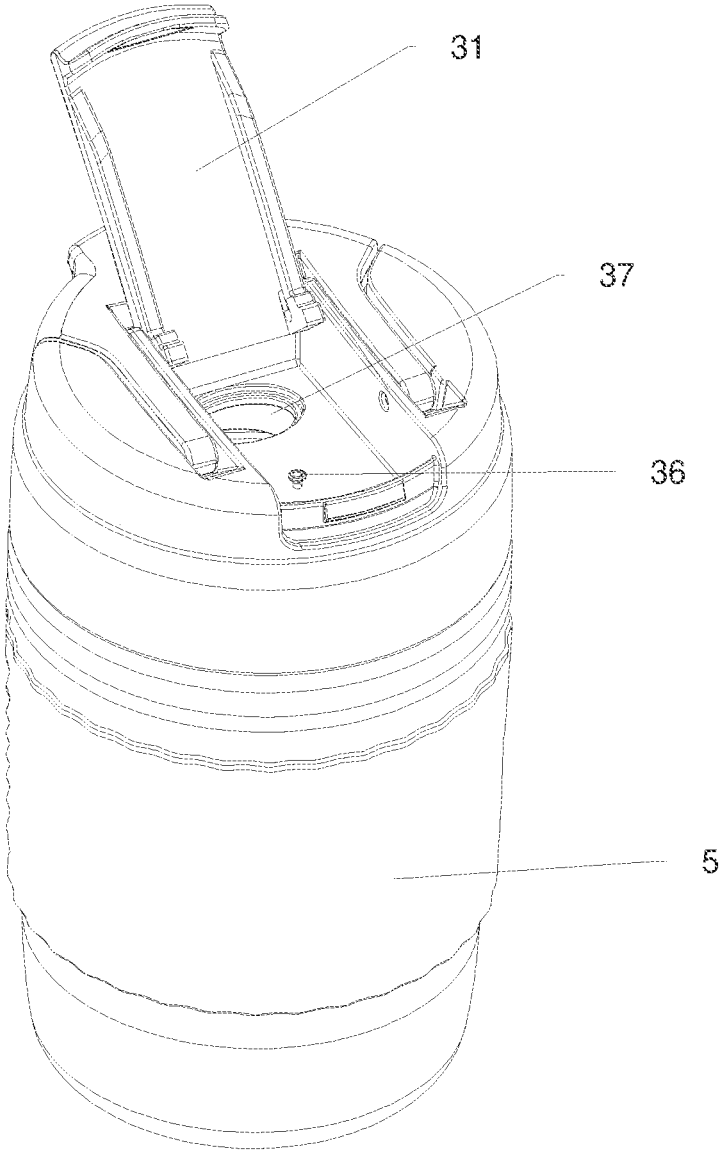
FIG. 1*a* is a schematic perspective structural view of a dual drinking-mode cup of the disclosure in which a drinking nozzle flap is in an open state and a drinking nozzle is omitted.
Figure 2:
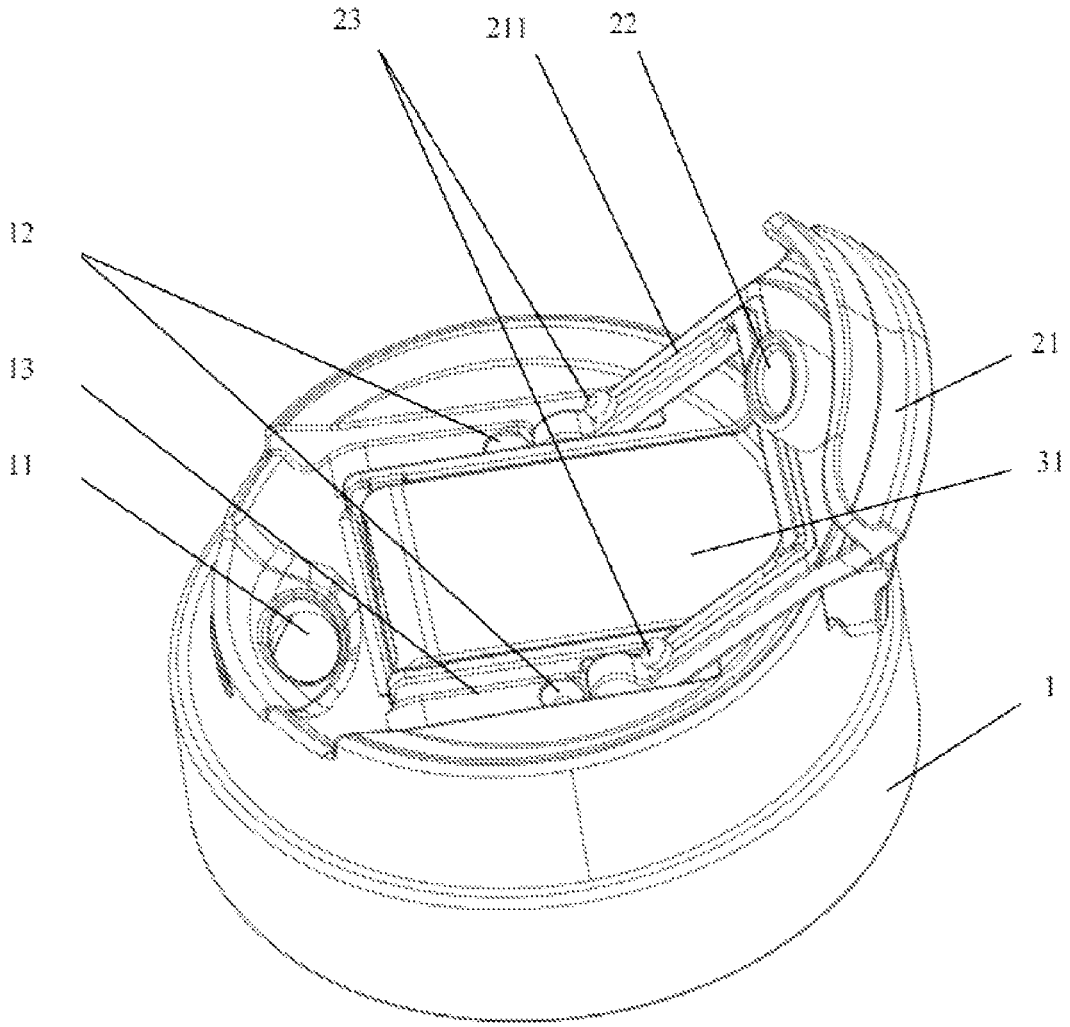
FIG. 2 is a schematic perspective structural view of the water-blocking and air-enterable structure in which a direct drinking mouth flap is in an open state.
Figure 3:
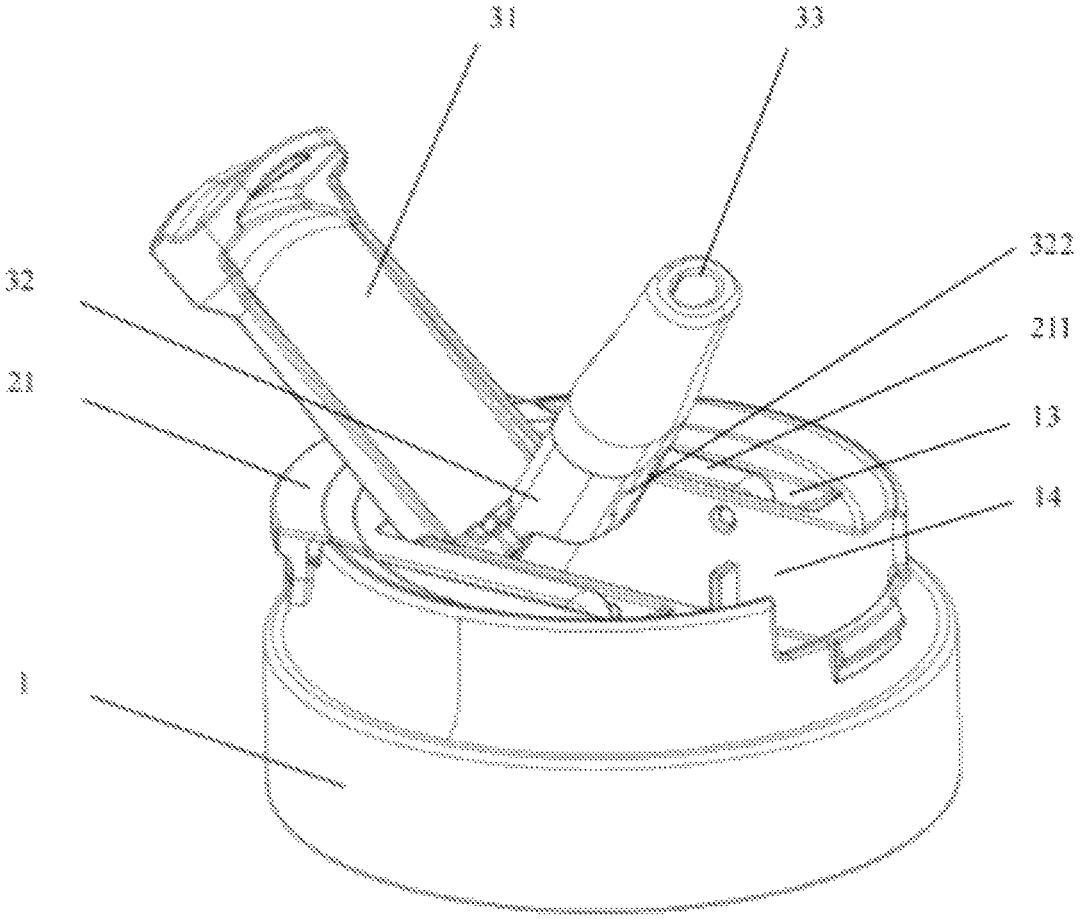
FIG. 3 is a schematic perspective structural view of the water-blocking and air-enterable structure in which a drinking nozzle flap is in the open state.
Figure 4:
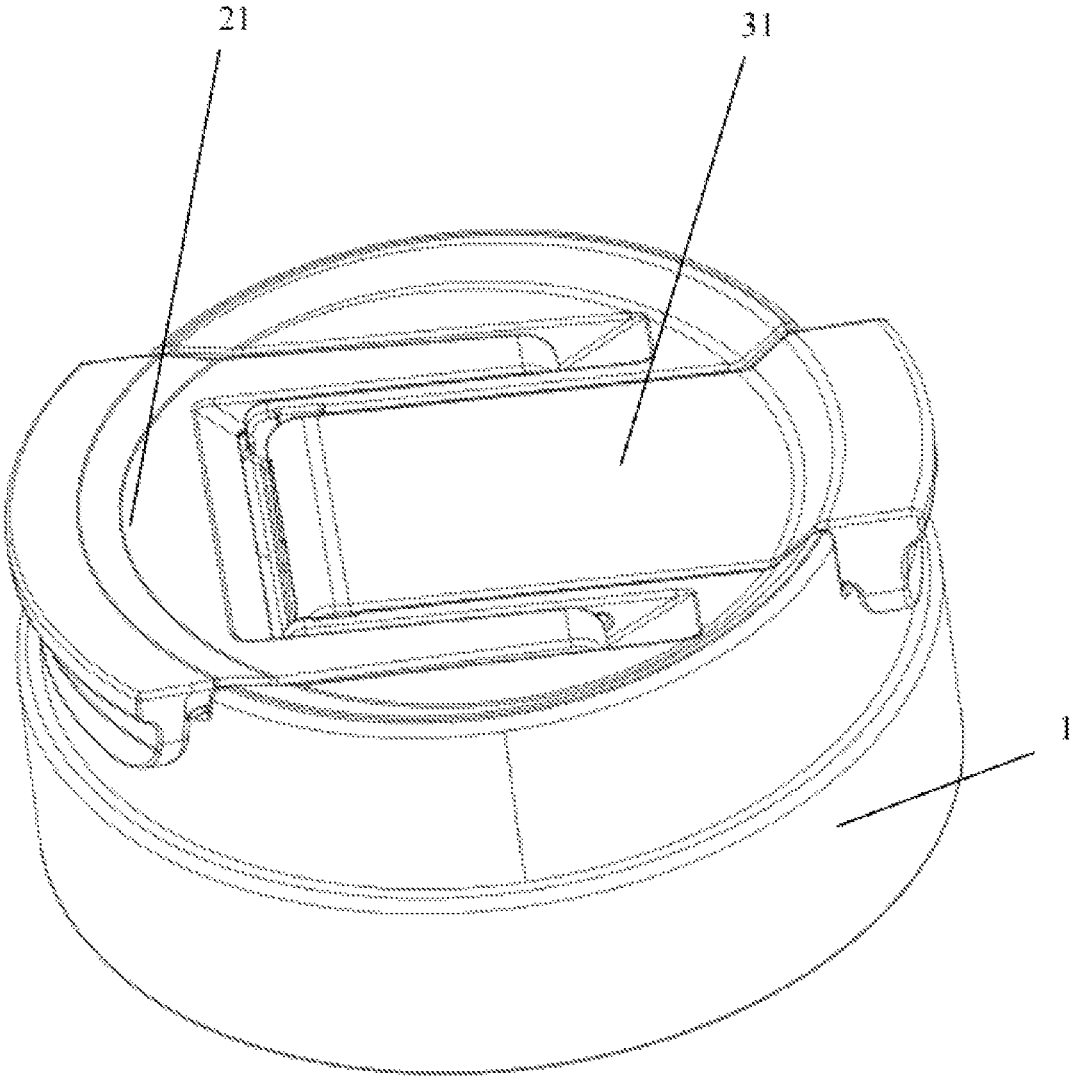
FIG. 4 is a schematic perspective structural view of the water-blocking and air-enterable structure in which the direct drinking mouth flap and the drinking nozzle flap are in closed states.

In a preferred embodiment, the cup lid 1 is provided with a water-blocking silicone ring 4 as shown in FIG. 1.

Figure 5:
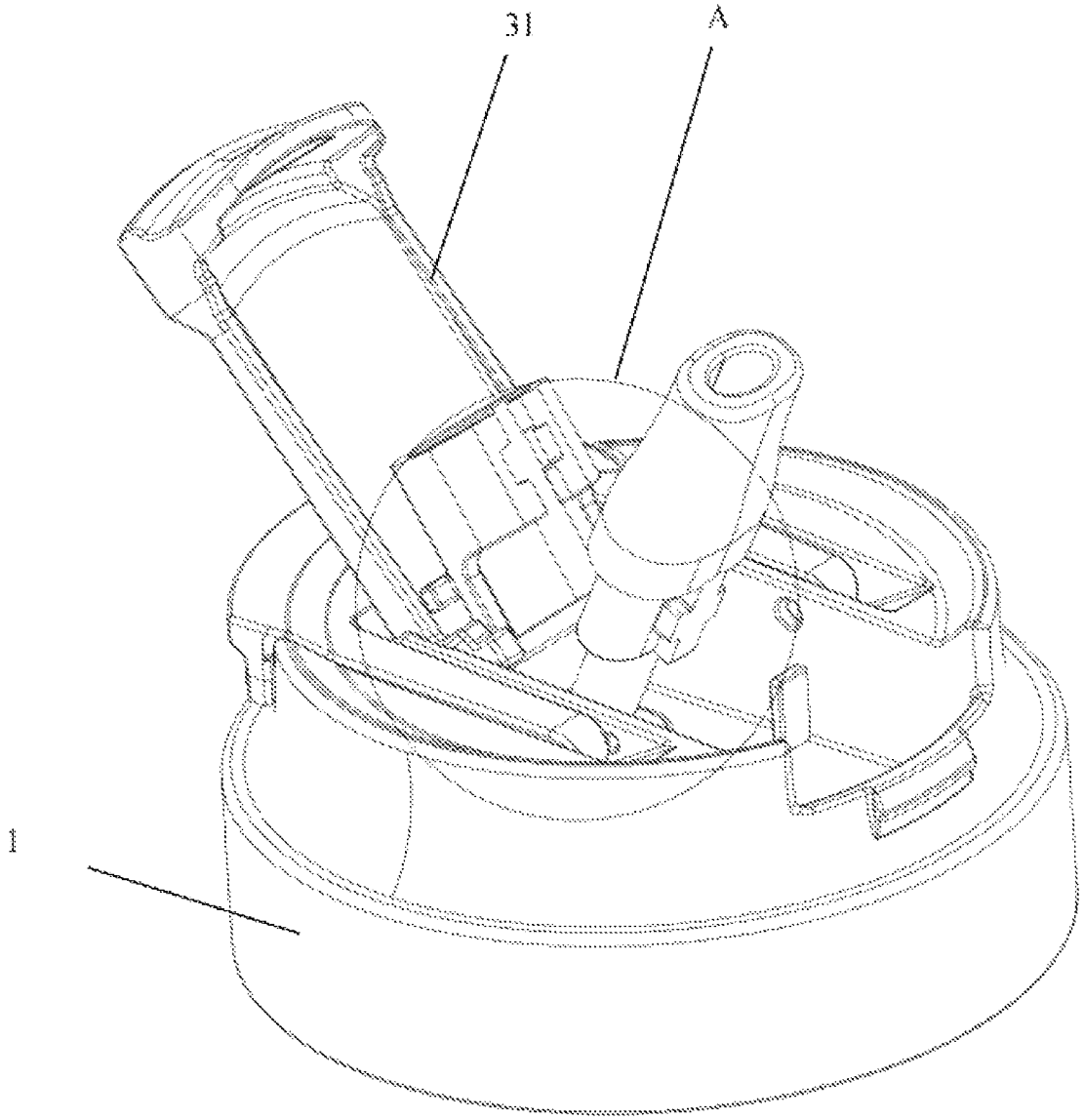
FIG. 5 is a schematic perspective structural view of the water-blocking and air-enterable structure in which a drinking nozzle seat and a drinking nozzle are in a state of being separated from each other.
Figure 6:
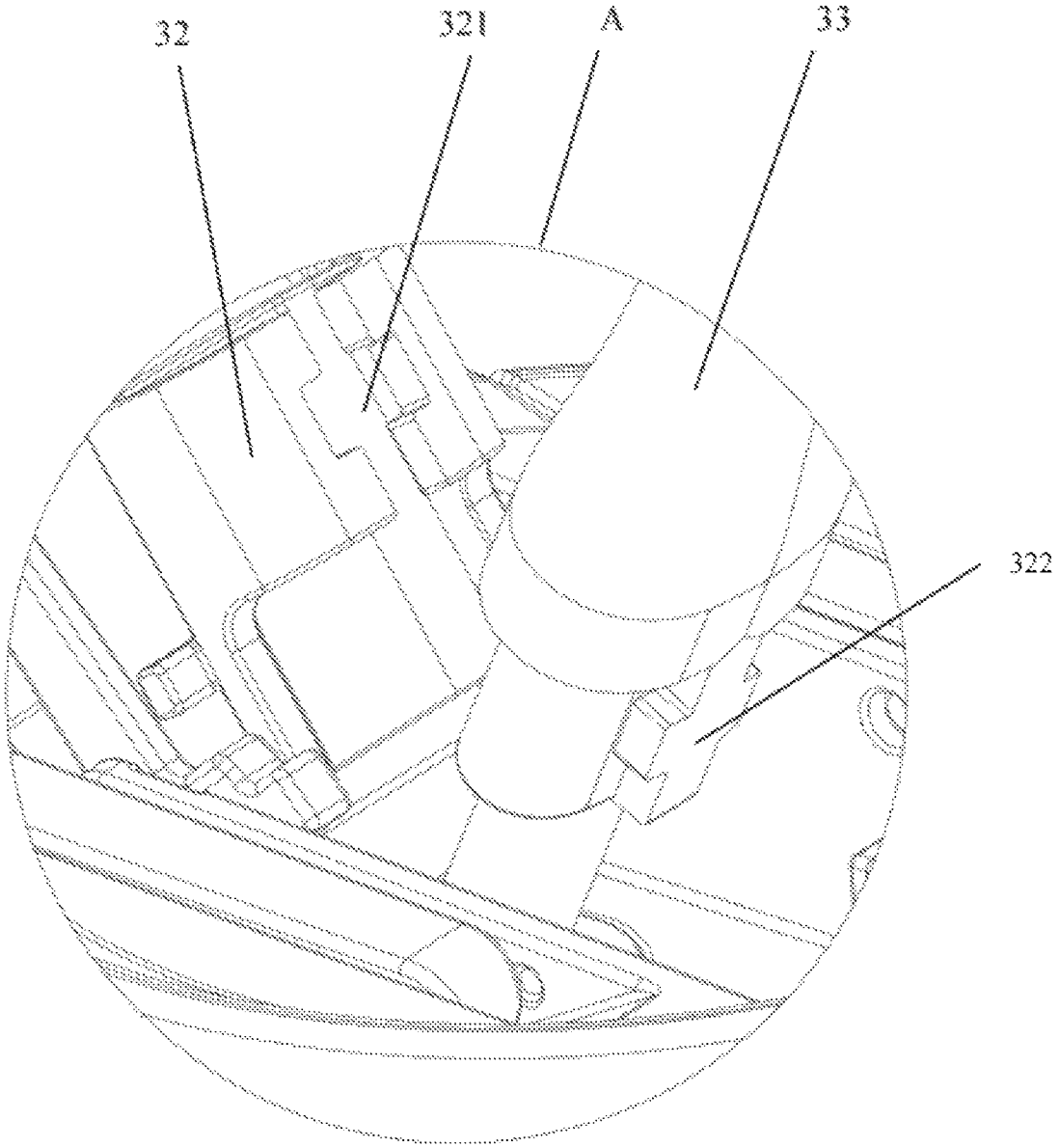
FIG. 6 is a schematic enlarged view of the portion A in FIG. 5.

In a preferred embodiment, referring to FIG. 5 and FIG. 6, the drinking nozzle 33 is provided with a snapping rib 322, the drinking nozzle seat 32 is provided with a fitting groove 321, and the snapping rib 322 is snapped into the fitting groove 321. During the drinking nozzle 33 is assembled on the drinking nozzle seat 32, the upper end of the drinking nozzle 33 passes through the drinking nozzle seat 32, and the snapping rib 322 of the drinking nozzle 33 is snapped into the fitting groove 321 to realize a function of limiting a position of the drinking nozzle 33 and thereby prevent the drinking nozzle 33 held by the mouth of the user in a drinking process from moving upwards in the drinking nozzle seat 32.

The specific embodiments of the disclosure are described in detail above, but they are only examples, and the disclosure is not limited to the specific embodiments described above. For those skilled in the art, any equivalent modifications and substitutions made to the disclosure are also within the scope of the disclosure. Therefore, equivalent transformations and modifications made without departing from the spirit and scope of the disclosure shall be included in the scope of the disclosure.

What is claimed is:

1. A water-blocking and air-enterable structure of a dual drinking-mode cup, comprising a cup lid (1) arranged on an upper end of a cup body (5), and the cup lid (1) being disposed with a direct drinking mouth assembly and a drinking nozzle assembly;

wherein the direct drinking mouth assembly comprises: a direct drinking mouth flap (21), a direct drinking mouth plug (22), and an air inlet plug (23); an end of the direct drinking mouth flap (21) is rotatably connected to the cup lid (1), the cup lid (1) is provided with a spout (11) and a first air inlet (12), the direct drinking mouth plug (22) and the air inlet plug (23) both are arranged on the direct drinking mouth flap (21), the direct drinking mouth plug (22) is configured for being plugged into the spout (11) along with a rotation of the direct drinking mouth flap (21), and the air inlet plug (23) is configured for being plugged into the first air inlet (12) along with a rotation of the direct drinking mouth flap (21);

wherein the drinking nozzle assembly comprises: a drinking nozzle flap (31), a drinking nozzle seat (32), a drinking nozzle (33), and an air inlet valve (34); an end of the drinking nozzle flap (31) is rotatably connected to the cup lid (1), and a lower end of the drinking nozzle (33) is fixed into the cup lid (1), the drinking nozzle (33) is communicated with the cup body, a side of the cup lid (1) near the drinking nozzle (33) is formed with a second air inlet (36), the air inlet valve (34) is plugged into the second air inlet, the lower end of the drinking nozzle (33) is connected to the air inlet valve (34) by a plastic strip (35), an end of the drinking nozzle seat (32) is hinged to the drinking nozzle flap (31), and another end of the drinking nozzle seat (32) is sleeved onto the drinking nozzle (33);

wherein a bottom of the cup lid (1) is provided with a limiting slot (37), the lower end of the drinking nozzle (33) is provided with a connector (331), the connector (331) is a hollow cylindrical structure, and an outer wall at an upper end of the connector (331) extends outwards to form a small ring-shaped protrusion (332), an outer wall of a middle part of the connector (331) extends outwards to form a large ring-shaped protrusion (333), a ring-shaped groove (334) is defined between the small ring-shaped protrusion (332) and the large ring-shaped protrusion (333), and the connector (331) is interference fitted into the limiting slot (37).

2. The water-blocking and air-enterable structure according to claim 1, wherein a top of the cup lid (1) is provided with two parallel elongated grooves (13) transversally extended, and a bottom wall of each of the elongated grooves (13) is formed with the first air inlet (12) downwardly extended, and the direct drinking mouth flap (21) is U-shaped, each of two side bars (211) of the direct drinking mouth flap (21) is provided with the air inlet plug (23), and two the air inlet plugs (23) on the two side bars (211) are configured for being respectively plugged into two the first air inlets (12) formed on the bottom walls of the elongated grooves (13) along with a rotation of the direct drinking mouth flap (21).

3. The water-blocking and air-enterable structure according to claim 2, wherein the top of the cup lid (1) is provided with an accommodating groove (14), the accommodating groove (14) is located between the two elongated grooves (13), and an upper end of the drinking nozzle (33) bends into the accommodating groove (14) along with a rotation of the drinking nozzle flap (31), and an upper end of the second air inlet penetrates through an inner bottom wall of the accommodating groove (14).

4. The water-blocking and air-enterable structure according to claim 1, wherein the cup lid (1) is provided with a water-blocking silicone ring (4).

5. The water-blocking and air-enterable structure according to claim 1, wherein the drinking nozzle (33) is provided with a snapping rib (322), the drinking nozzle seat (32) is provided with a fitting groove (321), and the snapping rib (322) is snapped into the fitting groove (321).

6. A water-blocking and air-enterable structure, comprising: a cup lid disposed with a direct drinking mouth assembly and a drinking nozzle assembly;

wherein the direct drinking mouth assembly comprises: a direct drinking mouth flap, a direct drinking mouth plug, and an air inlet plug; an end of the direct drinking mouth flap is rotatably connected to the cup lid, the cup lid is provided with a spout and an air inlet, the direct drinking mouth plug and the air inlet plug both are arranged on the direct drinking mouth flap, the direct drinking mouth plug is configured to be plugged into the spout along with a rotation of the direct drinking mouth flap, and the air inlet plug is configured to be plugged into the first air inlet along with a rotation of the direct drinking mouth flap;

wherein the drinking nozzle assembly comprises: a drinking nozzle flap, a drinking nozzle seat, a drinking nozzle, and an air inlet valve; an end of the drinking nozzle flap is rotatably connected to the cup lid, and a lower end of the drinking nozzle is arranged fixedly connected to and penetrating through the cup lid, the air inlet valve is arranged penetrating through the cup lid, the lower end of the drinking nozzle is connected to the air inlet valve by a strip, an end of the drinking nozzle seat is hinged to the drinking nozzle flap, and another end of the drinking nozzle seat is sleeved onto the drinking nozzle;

wherein the direct drinking mouth flap, the direct drinking mouth plug and the air inlet plug together form an integral structure;

wherein the drinking nozzle, the air inlet valve and the strip together form another integral structure;

wherein the lower end of the drinking nozzle is provided with a connector, the connector is a hollow cylindrical structure, and an outer wall at an upper end of the connector extends outwards to form a small ring-shaped protrusion, an outer wall of a middle part of the connector extends outwards to form a large ring-shaped protrusion, a ring-shaped groove is defined between the small ring-shaped protrusion and the large ring-shaped protrusion, and the connector is arranged penetrating through and held by the cup lid.

7. The water-blocking and air-enterable structure according to claim 6, wherein a top of the cup lid is provided with two parallel elongated grooves transversally extended, and a bottom wall of each of the elongated grooves is formed with the air inlet downwardly extended, and the direct drinking mouth flap is U-shaped, each of two side bars of the direct drinking mouth flap is provided with the air inlet plug, and two the air inlet plugs on the two side bars are configured for being respectively plugged into two the first air inlets formed on the bottom walls of the elongated grooves along with a rotation of the direct drinking mouth flap.

8. The water-blocking and air-enterable structure according to claim 7, wherein the top of the cup lid is provided with an accommodating groove, the accommodating groove is located between the two elongated grooves, an upper end of the drinking nozzle bends into the accommodating groove along with a rotation of the drinking nozzle flap, and the air inlet valve penetrates through an inner bottom wall of the accommodating groove.

9. The water-blocking and air-enterable structure according to claim 6, wherein the cup lid is provided with a water-blocking silicone ring.

10. The water-blocking and air-enterable structure according to claim 6, wherein the drinking nozzle is provided with a snapping rib, the drinking nozzle seat is provided with a fitting groove, and the snapping rib is snapped into the fitting groove.

* * * * *